US008104516B2

(12) United States Patent
Moriya et al.

(10) Patent No.: US 8,104,516 B2
(45) Date of Patent: Jan. 31, 2012

(54) GAS SUPPLY UNIT AND GAS SUPPLY SYSTEM

(75) Inventors: Shuji Moriya, Nirasaki (JP); Hideki Nagaoka, Nirasaki (JP); Tsuneyuki Okabe, Oshu (JP); Hiroshi Itafuji, Kasugai (JP); Hiroki Doi, Kasugai (JP); Minoru Ito, Kasugai (JP)

(73) Assignees: CKD Corporation, Komaki-shi (JP); Tokyo Electron Limited, Tokyo (JP)

( * ) Notice: Subject to any disclaimer, the term of this patent is extended or adjusted under 35 U.S.C. 154(b) by 665 days.

(21) Appl. No.: 12/226,416

(22) PCT Filed: Jun. 2, 2006

(86) PCT No.: PCT/JP2006/311055
§ 371 (c)(1),
(2), (4) Date: Oct. 17, 2008

(87) PCT Pub. No.: WO2007/141828
PCT Pub. Date: Dec. 13, 2007

(65) Prior Publication Data

US 2009/0165872 A1 Jul. 2, 2009

(51) Int. Cl.
*F16K 11/10* (2006.01)

(52) U.S. Cl. ..... 137/884

(58) Field of Classification Search ..... 137/269, 137/271, 597, 884
See application file for complete search history.

(56) References Cited

U.S. PATENT DOCUMENTS

| | | | | |
|---|---|---|---|---|
| 5,769,110 | A * | 6/1998 | Ohmi et al. | 137/269 |
| 6,415,822 | B1 | 7/2002 | Hollingshead | |
| 6,615,871 | B2 * | 9/2003 | Ohmi et al. | 137/884 |
| 6,769,463 | B2 * | 8/2004 | Vu | 141/98 |
| 7,152,629 | B2 * | 12/2006 | Tokuda et al. | 137/884 |
| 7,874,316 | B2 * | 1/2011 | Okabe et al. | 137/884 |

FOREIGN PATENT DOCUMENTS

| | | |
|---|---|---|
| JP | A-63-163002 | 7/1988 |
| JP | A-5-203100 | 8/1993 |
| JP | A-06-272796 | 9/1994 |
| JP | A-9-16267 | 1/1997 |
| JP | A-10-220698 | 8/1998 |

(Continued)

OTHER PUBLICATIONS

Jan. 19, 2010 Office Action issued in Japanese Application No. 2005-051544 (with translation).

(Continued)

*Primary Examiner* — John Fox
(74) *Attorney, Agent, or Firm* — Oliff & Berridge, PLC

(57) ABSTRACT

A gas supply unit and a gas supply system that are small-sized and inexpensive. The gas supply unit is installed on operation gas conveyance pipeline and has fluid control devices communicated via flow path blocks and controlling operation gas. The gas supply unit has the first flow path block, to one side of which an inlet open/close valve included in the fluid control devices is attached, and also has the second flow path block, to one side of which a purge valve included in the fluid control devices is attached. The first flow path block and the second flow path block are layered in the direction perpendicular to the conveyance direction of the operation gas. The inlet open/close valve and the purge valve are arranged between a mass flow controller installed on the operation gas conveyance pipeline and an installation surface where the unit is installed.

8 Claims, 16 Drawing Sheets

FOREIGN PATENT DOCUMENTS

| | | | |
|---|---|---|---|
| JP | A-11-159649 | | 6/1999 |
| JP | U-3085232 | | 1/2002 |
| JP | A-2002-517697 | | 6/2002 |
| WO | WO 96/29529 | | 9/1996 |
| WO | WO 02/093053 | A1 | 11/2002 |

OTHER PUBLICATIONS

Jul. 7, 2011 Office Action issued in Taiwanese Patent Application No. 095119656 (with Engish Translation).

* cited by examiner

GAS SUPPLY UNIT AND GAS SUPPLY SYSTEM

TECHNICAL FIELD

The present invention relates to a gas supply unit and a gas supply system installed on a supply gas conveyance pipeline and provided with fluid control devices for controlling supply gas.

BACKGROUND ART

Heretofore, in a semiconductor manufacturing process, corrosive gas is employed for etching or the like in a photoresist process. The photoresist process (photoresist coating, exposure, development, and etching) is repeated several times in the semiconductor manufacturing process. Therefore, a gas supply unit for supplying the corrosive gas as required is employed in the actual semiconductor manufacturing process.

FIG. 15 is one example of a circuit diagram of the gas supply unit.

In the gas supply unit, operation gas and purge gas flow from a left side to a right side of the gas supply unit in the figure. An operation gas supply source 1 is sequentially connected to a regulator 2, a pressure sensor 3, an inlet open/close valve (corresponding to "a first fluid control device" in Claims) 4, a mass flow controller 5, and an outlet open/close valve 6. An outlet port of the outlet open/close valve 6 is connected to a vacuum chamber 7. On the other hand, a purge gas supply source 8 is connected to a purge valve (corresponding to "a second fluid control device" in Claims) 9. An output port of the purge valve 9 is connected to and between the inlet open/close valve 4 and the mass flow controller 5.

FIG. 16 is a side view of a conventional gas supply unit 100 embodying the circuit diagram in FIG. 15.

The conventional gas supply unit 100 has the following configuration. The regulator 2 is fixed on top surfaces of an input block 101 and a flow path block 102 by bolts fastened from above, and an input port of the regulator 2 communicates with the operation gas supply source 1 via the input block 101. The pressure sensor 3 is fixed on top surfaces of the flow path block 102 and a flow path block 103 by bolts fastened from above, and an input port of the pressure sensor 3 communicates with an output port of the regulator 2. The inlet open/close valve 4 is fixed on top surfaces of the flow path block 103 and a flow path block 104 by bolts fastened from above, and an input port of the inlet open/close valve 4 communicates with an output port of the pressure sensor 3. The purge valve 9 is fixed on top surfaces of the flow path block 104, a flow path block 105, and a purge block 108 by bolts fastened from above. An operation gas input port of the purge valve 9 communicates with an output port of the inlet open/close valve 4, and a purge gas input port of the purge valve 9 communicates with the purge gas supply source 8 via the purge block 108. The mass flow controller 5 is fixed on top surfaces of the flow path block 105 and a flow path block 106 by bolts fastened from above, and an input port of the mass flow controller 5 communicates with a common output port of the purge valve 9. The outlet open/close valve 6 is fixed on top surfaces of the flow path block 106 and an output block 107 by bolts fastened from above, and an output port of the outlet open/close valve 6 communicates with the vacuum chamber 7 via the output block 107. The gas supply unit 100 is configured with each device 2 to 9 being fixed by the bolts fastened from above, so that an overall length can be shorter, and the unit 100 can be made compact compared to a case where all the devices 2 to 9 are connected by use of pipes (see Patent Document 1).

Further, the mass flow controller 5 is held in a raised position by the flow path blocks 105 and 106 to create a clearance from an installation surface. In this case, either of the inlet open/close valve 4 or the outlet open/close valve 6, which requires less frequency in replacement, is installed sideways on the flow path blocks 105 and 106 and arranged between the mass flow controller 5 and the installation surface, thereby the overall length of the gas supply unit is further shortened. Such a technique has been already proposed (see Patent Document 2).

Patent Document 1: Japanese Unexamined Patent Publication No. 11 (1999)-159649

Patent Document 2: International Publication No. WO2002/093053

DISCLOSURE OF INVENTION

Problems to be Solved by the Invention

The conventional gas supply unit 100 is arranged in a manner that the devices 2 to 9 are mounted on the blocks 101 to 107 from above, and a device is installed between the mass flow controller 5 and the installation surface to make the unit 100 compact. However, even such arrangements are still not enough to meet today's demand for a more compact operation gas supply unit. In other words, there are unnecessary spaces existed between the devices 2 to 4 and the installation surface, resulting in a large footprint. Further, each one device is fixed with two blocks to be communicated with other devices, so the number of the blocks and sealing portions increase to seal connecting portions among the devices and the blocks. Consequently, the conventional gas supply unit requires higher material cost for materials such as blocks and sealing members and higher processing cost for processing the sealing portions, leading to total cost increase.

The present invention has been made to solve the above problems and has a purpose to provide a compact and inexpensive gas supply unit and a gas supply system.

Means for Solving the Problems

To achieve the above-mentioned objects, a gas supply unit of the present invention is formed with the following configuration.

(1) A gas supply unit that is to be installed on an operation gas conveyance pipeline and includes a plurality of fluid control devices communicating with one another via flow path blocks to control operation gas, comprises a first flow path block having a side surface on which a first fluid control device included in the fluid control devices is attached and a second flow path block having a side surface on which a second fluid control device included in the fluid control devices is attached, wherein the first flow path block and the second flow path block are stacked one on top of the other in a direction perpendicular to a conveyance direction of the operation gas, and the first fluid control device and the second fluid control device are arranged between the fluid control devices installed on the operation gas conveyance pipeline and an installation surface on which the unit is to be installed.

(2) In the gas supply unit according to (1), preferably, the first flow path block is formed with at least one port each on a top surface and a bottom surface, the ports communicating with each other via the first fluid control device, and the second flow path block is formed with at least one port each on a top surface and a side surface opposite a side surface to which the second fluid control device is attached, the ports communicating with each other via the second fluid control device.

(3) In the gas supply unit according to (2), preferably, the first flow path block is formed with at least one port opening in a side surface opposite a side surface to which the first fluid control device is attached, the port communicating with the ports opening in the top surface and the bottom surface of the first flow path block via the fluid control device.

(4) In any one of the gas supply units according to (1) to (3), preferably, a bypass pipe for connecting the first flow path block or the second flow path block to a flow path block installed on the operation gas conveyance pipeline is arranged between the fluid control device and the installation surface.

Further, to achieve the above-mentioned objects, a gas supply system of the present invention is formed with the following configuration.

(5) A gas supply system comprising a pair of brackets mounted on both ends of the gas supply unit according to any one of (1) to (4) for horizontally holding the gas supply unit, wherein the pair of brackets are fixed to an installation member, thereby the gas supply unit is integrated.

Advantages of the Invention

Operations and advantages of the present invention are now explained.

In a gas supply unit of the present invention, for example, to supply operation gas in the horizontal direction, a first flow path block and a second flow path block are put in a direction perpendicular, or a vertical direction with respect to a conveyance direction of the operation gas. Thereby, a first fluid control device attached to one side surface of the first flow path block and a second fluid control device attached to one side surface of the second flow path block are installed sideways in a clearance between a fluid control device arranged on an operation gas supply pipeline and an installation surface to which the gas supply unit is attached. In short, among fluid control devices installed in the gas supply unit, the fluid control devices except the first and second fluid control devices are arranged on the operation gas conveyance pipeline. Moreover, the first and second flow path blocks are stacked in the direction perpendicular to omit unnecessary spaces in the overall length direction of the unit, so that unnecessary spaces among the flow path blocks are reduced compared to a case where one fluid control device is fixed to two flow path blocks. In this case, the first and second fluid control devices are directly attached to the first and second flow path blocks respectively. Consequently, in the gas supply unit, the number of the blocks and sealing portions can be reduced compared to the case where one device is fixed to two flow path blocks.

As a result, in the gas supply unit of the present invention, unnecessary spaces among the flow path blocks are reduced as well as the number of the fluid control devices installed on the operation gas conveyance pipeline is reduced, so that the overall length of the unit can be shortened and the unit itself can be made compact. Furthermore, in the gas supply unit of the present invention, by reducing the number of the blocks and the sealing portions, cost reduction on material cost and processing cost can be achieved.

When the first flow path block and the second flow path block are stacked perpendicularly, a port opening in a bottom surface of the first flow path block and a port opening in a top surface of the second flow path block are mutually communicated. In the first flow path block, ports opening in a top surface and the bottom surface are communicated via the first fluid control device. In the second flow path block, ports opening in the top surface and a side surface opposite a side surface to which the second fluid control device is attached are communicated via the second fluid control device. Therefore, fluid supplied to the port opening in the side surface of the second flow path block can be outputted from the port opening in the top surface of the first flow path block via the first fluid control device, and then supplied to the fluid control device installed on the operation gas conveyance pipeline.

Consequently, in the gas supply unit of the present invention, only by stacking the first and second flow path blocks, a flow path capable of controlling the fluid by use of the first and second fluid control devices can be easily formed in the perpendicular direction.

Especially, in a case where the first flow path block is formed with a port in a side surface opposite a side surface to which the first fluid control device is attached in addition to the ports in the top and bottom surfaces in a state that all the ports are mutually communicated via the first fluid control device, fluid control devices other than the first fluid control device and flow path blocks can be directly connected and joined to this side surface. Thereby, it is possible to reduce the number of the fluid control devices to be installed on the operation gas conveyance pipeline and to reduce unnecessary spaces among the flow path blocks, so that the unit can be made compact.

As mentioned above, when the first and second flow path blocks are stacked perpendicularly, extra clearance could be created between the fluid control device installed on the operation gas conveyance pipeline and the installation surface. Is such a case, one end of a bypass pipe may be connected to the first or second flow path block, and the other end thereof may be connected to a flow path block installed on the operation gas conveyance pipeline. Accordingly, the bypass pipe is arranged between the fluid control device installed on the operation gas conveyance pipeline and the installation surface, thereby the bypass pipe can be provided in an occupation space for one line.

The above-mentioned gas supply unit is horizontally held by a pair of brackets which are mounted on both ends of the gas supply unit, and is integrated by fixing the brackets to an installation member. Such the systemized gas supply system employs a compact and inexpensive gas supply unit, so that the system itself can also be downsized and cost-reduced.

EXPLANATION FOR REFERENCE CODES

Figure 1:
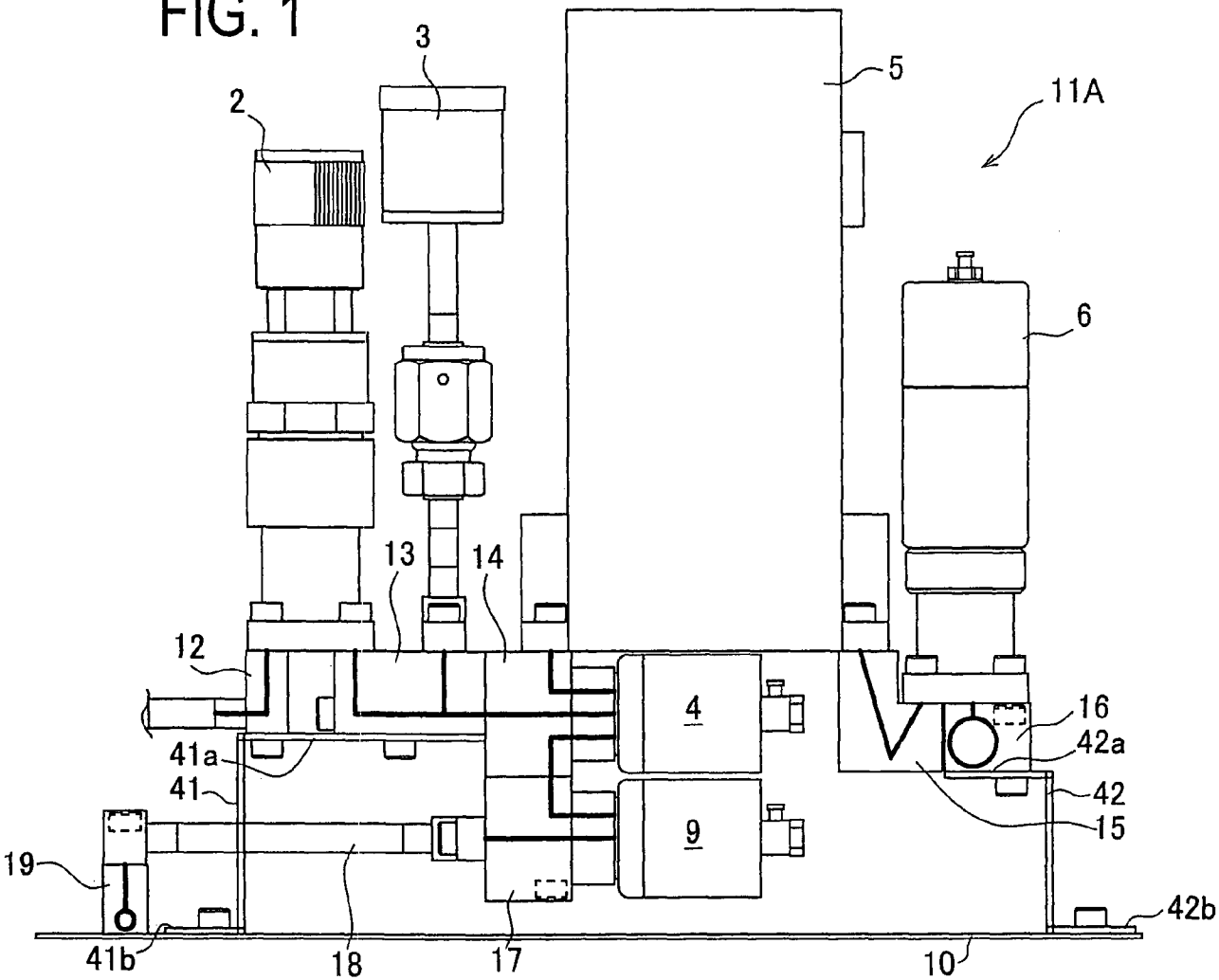
FIG. 1 is a side view of a gas supply unit in a first embodiment of the present invention.

2-6, 9 Fluid control device
4 Inlet open/close valve
9 Purge valve
11A-11D Gas supply unit
14 First flow path block
17 Second flow path block
22 First port
23 Second port
24 Third port
32 First port
33 Second port
51-53 Fluid control device
53 First purge valve
56 Bypass pipe
61-63 Fluid control device
74 First port

BEST MODE FOR CARRYING OUT THE INVENTION

A detailed description of preferred embodiments of a gas supply unit, a gas supply system, and flow path blocks embodying the present invention will now be given referring to the accompanying drawings.

First Embodiment

A gas supply unit in the first embodiment of the present invention is explained. FIG. 1 is a side view of a gas supply unit 11A.

Figure 15:
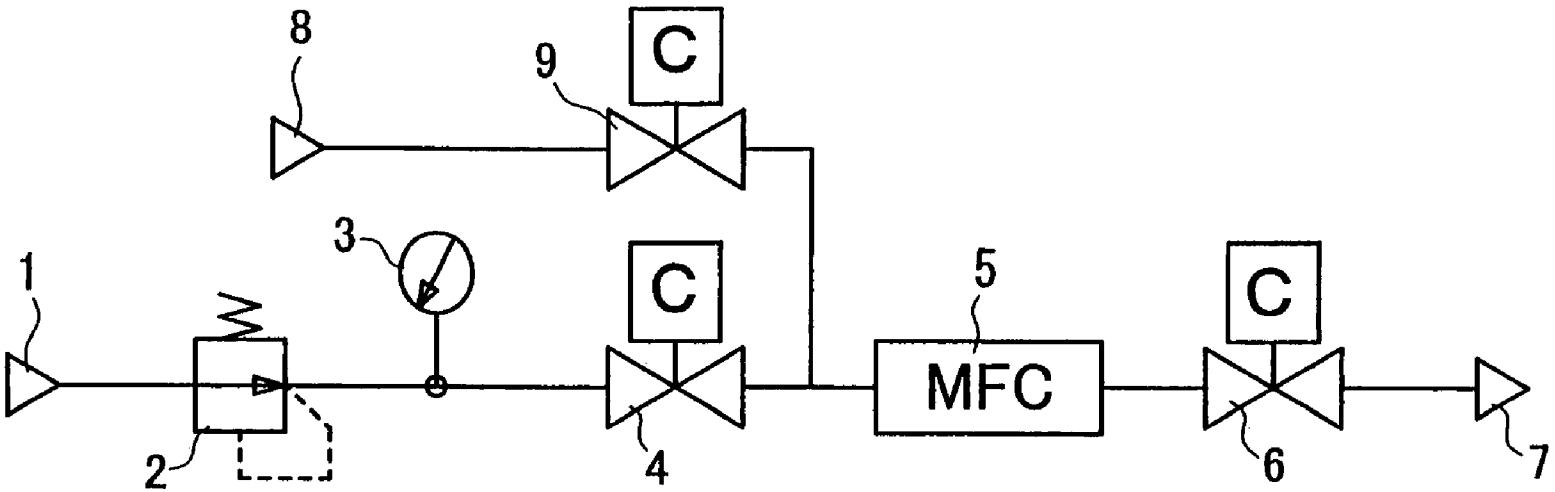
FIG. 15 is one example of a circuit diagram of a gas supply unit.
Figure 16:
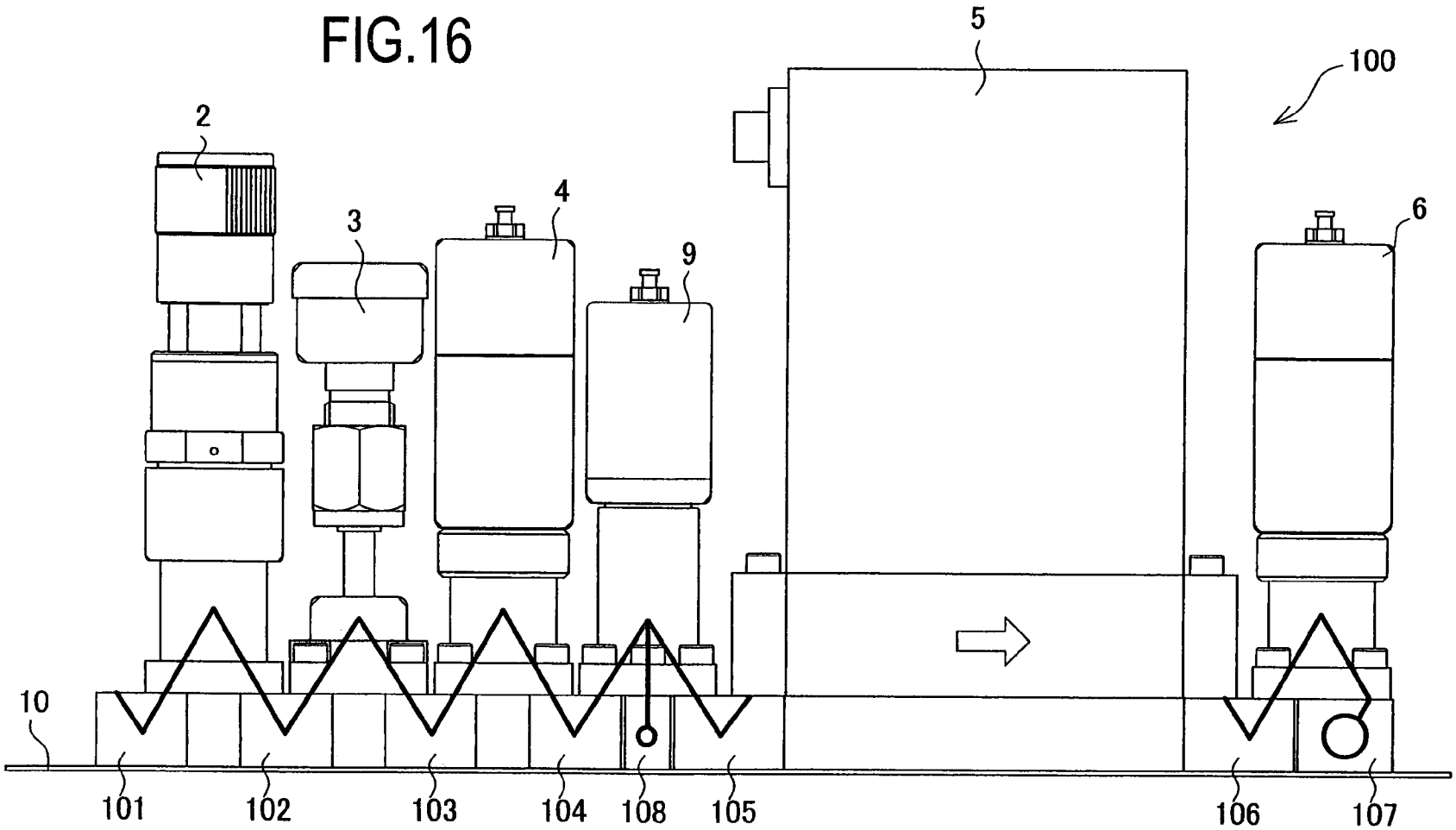
FIG. 16 is a side view of a conventional gas supply unit embodying the circuit in FIG. 15.

The gas supply unit 11A embodies a circuit shown in FIG. 15 to make a difference clear from a conventional gas supply unit 100 in FIG. 16. Same configurations as those of the conventional gas supply unit in FIG. 16 are designated by the same reference codes. The gas supply unit 11A is formed with a regulator 2, a pressure sensor 3, an inlet open/close valve 4, a mass flow controller 5, an outlet open/close valve 6, and a purge valve 9 which are all serving as fluid control devices, and these devices 2 to 9 are mounted on blocks 12 to 17 to communicate with each other, forming a stick-like shape. The devices 2 to 9 and the blocks 12 to 17 are made of rigid metal such as stainless steel or the like taking account of thermal resistance and rigidity. The gas supply unit 11A is characterized in that a flow path block (corresponding to "a first flow path block" in Claims) 4 and a flow path block (corresponding to "a second flow path block" in Claims) 17 are stacked in a direction perpendicular or longitudinal to a conveyance direction of the operation gas.

In the gas supply unit 11A, the regulator 2 is fixed on top surfaces of an input block 12 and a flow path block 13 by bolts fastened from above, and an input port of the regulator 2 communicates with an operation gas supply source 1 via the input block 12. In the flow path block 13, an L-shaped flow path is formed to flow operation gas from a port connected to an output port of the regulator 2 to a port provided in a right side surface of the flow path block 13 in the figure. The flow path block 13 further includes a branch flow path which branches off from the L-shaped flow path and opens upward. The pressure sensor 3 is aligned with the branch flow path and fixed on a top surface of the flow path block 13 by bolts fastened from above to measure fluid pressure of the operation gas flowing through the flow path block 13.

The flow path block 14 is fastened by a bolt running through the flow path block 13 from its left side surface, and thus fixed to the flow path block 13. On a right side surface of the flow path block 14, the inlet open/close valve 4 is mounted sideways. In other words, the inlet open/close valve 4 is arranged between the mass flow controller 5 and an installation surface. The inlet open/close valve 4 is an air-operated open/close control valve of which a valve body is constituted by the flow path block 14. The flow path block 14 will be explained thereafter.

The mass flow controller 5 is fixed on top surfaces of the flow path block 14 and a flow path block 15 by bolts fastened from above so that an input port of the mass flow controller 5 communicates with a common output port of the inlet open/close valve 4. The outlet open/close valve 6 is fixed on top surfaces of the flow path block 15 and an output block 16 by bolts fastened from above so that an output port of the outlet open/close valve 6 communicates with a vacuum chamber 7 via the output block 16. In addition, the flow path block 15 is placed as high as the flow path block 14 so as to hold the mass flow controller 5 horizontal. However, general-purpose products are employed as the output block 16 and hence the flow path block 15 is provided with a stepped portion for fixing the outlet open/close valve 6 at the same height with the output block 16.

On the other hand, the flow path block 14 is fastened by a bolt running through a flow path block 17 from bottom to fix the flow path block 17 to a bottom surface of the flow path block 14. The purge valve 9 is screwed sideways in a right side surface of the flow path block 17 in the figure. In short, the purge valve 9 and the inlet open/close valve 4 are placed one on the other between the mass flow controller 5 and the installation surface. The purge valve 9 is an air-operated open/close control valve of which a valve body is constituted by the flow path block 17. A purge block 19 is connected to the flow path block 17 via a purge pipe 18, thereby a purge gas input port of the purge valve 9 communicates with a purge gas supply source 8.

Figure 2A:
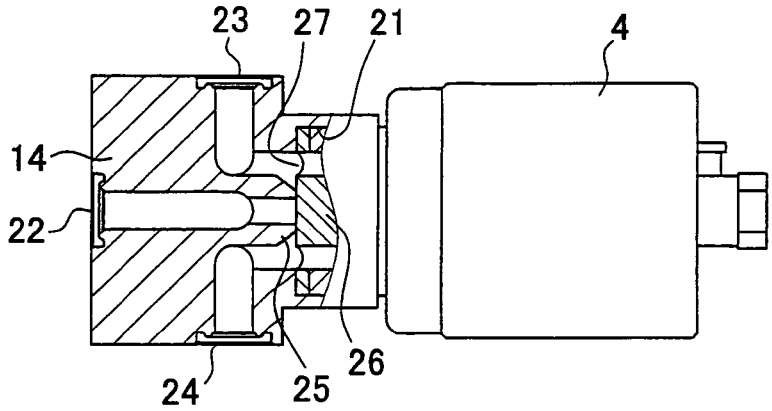
FIG. 2A is a sectional view of a main part of a flow path block on which a flow control device is mounted, showing a structure of the flow path block employed in the gas supply unit in the first embodiment.

Configuration of the flow path block 14 is now explained. FIG. 2 show a structure of the flow path block 14 used for the gas supply unit 11A. FIG. 2A is a sectional view showing a main part of the flow path block 14 in which the inlet open/close valve 4 is mounted, FIG. 2B is a left-side view, FIG. 2C is a top view, and FIG. 2D is a bottom view of the flow path block 14.

As shown in FIG. 2A, the flow path block 14 is of a nearly cubic shape. In a right side surface of the flow path block 14, a mounting hole 21 is cylindrically formed to threadedly receive the inlet open/close valve 4. The flow path block 14 has a first port 22 formed opening in a left side surface in the figure and extending coaxially with the mounting hole 21 to communicate with a center portion of the mounting hole 21 via a straight flow path. Further, the flow path block 14 has a second port 23 formed opening in its top surface and a third port 24 formed opening in its bottom surface in the figure. The second and third ports 23 and 24 communicate with the mounting hole 21 via L-shaped flow paths. At the bottom of the mounting hole 21, a valve seat 25 is provided around an opening portion communicating with the first port 22, and flow paths communicating with the second and third ports 23 and 24 are formed upward and downward in positions symmetric with respect to the valve seat 25. The mounting hole 21 of the flow path block 14 is hermetically partitioned by a diaphragm 26, thereby defining a valve chamber 27 which communicates with the first to third ports 22 to 24.

Figure 2B:
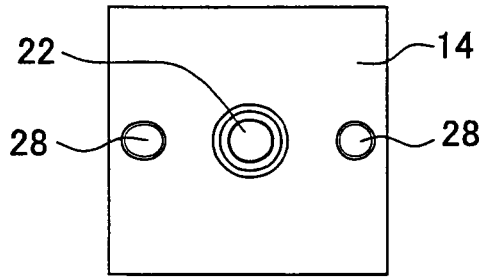
FIG. 2B is a left-side view of the flow path block in FIG. 2A.
Figure 2C:
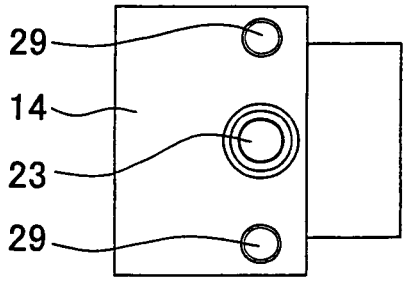
FIG. 2C is a top view of the flow path block in FIG. 2A.
Figure 2D:
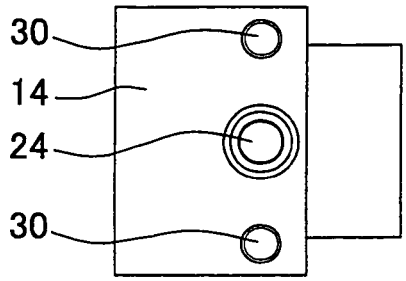
FIG. 2D is a bottom view of the flow path block in FIG. 2A.

Further, as shown in FIGS. 2B to 2D, the flow path block 14 is formed with pairs of bolt holes 28, 29, and 30 which are placed symmetrically with respect to the first port 22, the second port 23, and the third port 24 respectively.

Figure 3A:
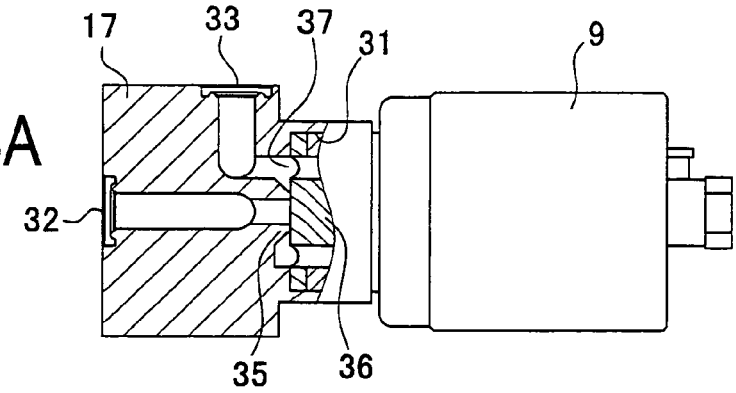
FIG. 3A is a sectional view of a main part of a flow path block on which a fluid control device is mounted, showing a structure of the flow path block employed in the gas supply unit in the first embodiment.

Configuration of the flow path block 17 is now explained. FIG. 3 show a structure of the flow path block 17 used for the gas supply unit 11A. FIG. 3A is a sectional view showing a main part of the flow path block 17 on which a fluid control device is mounted, FIG. 3B is a left-side view, FIG. 3C is a top view, and FIG. 3D is a bottom view of the flow path block 17.

As shown in FIG. 3A, the flow path block 17 is of a nearly cubic shape. In a right side surface of the flow path block 17, a mounting hole 31 is cylindrically formed to threadedly receive the purge valve 9. The flow path block 17 has a first port 32 formed opening in a left side surface in the figure and extending coaxially with the mounting hole 31 to communicate with a center portion of the mounting hole 31 via a straight flow path. Further, the flow path block 17 has a second port 33 formed opening in its top surface and communicating with the mounting hole 31 via an L-shaped flow path. At the bottom of the mounting hole 31, a valve seat 35 is provided around an opening portion communicating with the first port 32, and a flow path communicating with the second port 33 is formed around the valve seat 35. The mounting hole 31 of the flow path block 17 is hermetically partitioned by a diaphragm 36, thereby defining a valve chamber 37 which communicates with the first and second ports 32 and 33.

Figure 3B:
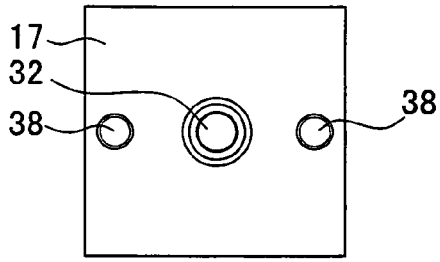
FIG. 3B is a left-side view of the flow path block in FIG. 3A.
Figure 3C:
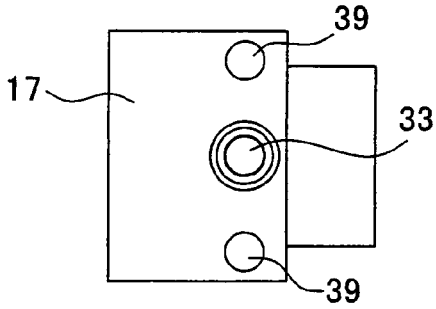
FIG. 3C is a top view of the flow path block in FIG. 3A.
Figure 3D:
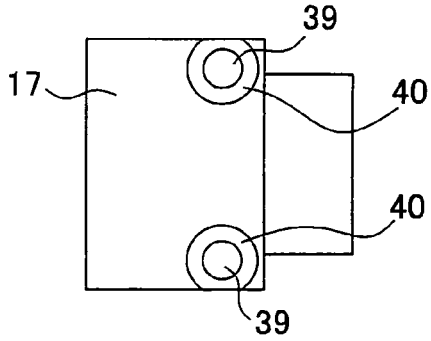
FIG. 3D is a bottom view of the flow path block in FIG. 3A.

As shown in FIG. 3B, in a left side surface of the flow path block 17, a pair of bolt holes 38 are formed symmetrically with respect to the first port 32. Further, as shown in FIGS. 3C and 3D, the flow path block 17 is formed with through holes 39 through each of which a bolt runs at symmetrical locations with respect to the second port 33. Moreover, at a bottom surface of the flow path block 17, stepped portions 40 are provided to lock the bolt heads as shown in FIG. 3D.

The above configured flow path blocks 14 and 17 are stacked one on the other and fixed by bolts. The flow path blocks 14 and 17 have identical outer shapes so that they can be replaced depending on a desired circuit. The second and third ports 23 and 24 of the flow path block 14 and the second port 33 of the flow path block 17 are arranged to be on the same axis when the flow path blocks 14 and 17 are stacked. Therefore, if a circuit is not intended to supply purge gas, for example, it may be arranged that the purge block 19, the purge pipe 18, and the purge valve 9 are omitted and the flow path block 17 is used in a single stack instead of the flow path block 14. In addition, for giving replaceability to the flow path blocks, in the flow path block 17, each of the thorough holes 39 is preferably formed with an internal thread on an inner periphery so that a bolt can be screwed therein.

The flow path block 14 and the flow path block 17 are mounted on the gas supply unit 11A as follows. As shown in FIG. 1, the flow path block 14 is integrated with the flow path block 13 in such a manner that the first port 22 is aligned with a port opening in a right side surface of the flow path block 13 in the figure with a gasket (not shown) being interposed therebetween, and then bolts inserted through the flow path block 13 from the left side surface to the right side surface are screwed in the bolt holes 28 formed in a left side surface of the flow path block 14. The flow path block 14 is then integrated with the mass flow controller 5 by fastening bolts inserted from above in bolt holes 29 on a top surface of the flow path block 14. The bottom surface of the flow path block 14 is in contact with a top surface of the flow path block 17 by interposing a gasket (not shown) between the third port 24 of the flow path block 14 and the second port 33 of the flow path block 17, and then bolts inserted through the through holes 39 of the flow path block 17 from beneath are fastened in bolt holes 30 of the flow path block 14, thus the flow path blocks 14 and 17 are integrated. The flow path block 17 is further integrated with the purge pipe 18 in such a manner that a gasket is arranged between the first port 32 and the purge pipe 18, and bolts inserted through a fixing block of the purge pipe 18 is fastened in the bolt holes 38 in a left side surface of the flow path block 17. In this case, each bolt is preferably fastened so as to press each gasket with uniform force to provide uniform sealing strength around each port.

The gas supply unit 11A is supported by brackets 41 and 42 and fixed to an installation plate 10, thereby configuring a gas supply system. The brackets 41 and 42 are made of metal plates, each of which is bent at both ends at right angles in opposite directions to provide contact portions 41*a* and 42*a* in contact with a bottom surface of the gas supply unit 11A and contact portions 41*b* and 42*b* in contact with the installation plate 10. The gas supply unit 11A is fixed to the brackets 41 and 42 by fastening bolts running through the contact portions 41*a* and 42*a* in the blocks 12, 13, and 16 respectively, and further the unit 11A is fixed to the installation plate 10 so as to be spaced above the installation plate by fastening bolts running through the contact portions 41*b* and 42*b* of the brackets 41 and 42 in the installation plate 10.

At this time, the purge pipe 18 runs through a through hole or a groove formed in the bracket 41, so that the purge pipe 18 can be installed straight beneath the regulator 2 and the pressure sensor 3, omitting unnecessary widthwise space in the gas supply unit 11A. Further, the purge block 19 is provided outside the bracket 41, so that installation of purge lines is facilitated when more gas supply units 11A are installed.

Operations and advantages of the gas supply unit 11A are now explained.

In the gas supply unit 11A, the inlet open/close valve 4, the outlet open/close valve 6, and the purge valve 9 are closed when neither operation gas nor purge gas is supplied.

In the gas supply unit 11A, when the operation gas is to be supplied, the inlet open/close valve 4 and the outlet open/close valve 6 are opened while the purge valve 9 is closed. Accordingly, the operation gas supplied from the operation gas supply source 1 to the input block 12 is pressure regulated by the regulator 2, and then, the operation gas is inputted to the first port 22 of the flow path block 14 via the flow path block 13. Since the purge valve 9 is being closed, the operation gas is supplied to the second port 23 sequentially via the first port 22, the valve seat 25, and the valve chamber 27. The operation gas is inputted from the second port 23 of the flow path block 14 to the mass flow controller 5 in which the flow rate is adjusted. Then, the operation gas is outputted to the vacuum chamber 7 via the outlet open/close valve 6 and the output block 16.

When the gas supply unit 11A is to conduct purging subsequently, the inlet open/close valve 4 is closed and the purge valve 9 is opened. Purge gas supplied from the purge gas supply source 8 to the purge block 19 is inputted to the first port 32 of the flow path block 17 via the purge pipe 18. The purge gas is then supplied to the second port 33 via the first port 32, the valve seat 35, and the valve chamber 37 and inputted to the third port 24 of the flow path block 14. When the purge gas flows into the valve chamber 27 from a flow path communicating with the third port 24, the purge gas is divided to flow in two directions around the valve seat 25, flowing into the flow path communicating with the second port 23. Subsequently, the purge gas is inputted to the mass flow controller 5 from the second port 23, and then outputted to the vacuum chamber 7 via the flow path block 15, the outlet open/close valve 6, and output block 16. At this time, the purge gas pushes out the residual operation gas by fluid pressure from the insides of the inlet open/close valve 4, the flow path block 14, the mass flow controller 5, the flow path block 15, the outlet open/close valve 6, and the output block 16, thus replacing gases. After that, the gas supply unit 11A closes the purge valve 9 to complete purging.

Consequently, in the gas supply unit 11A of the present embodiment, the flow path block 14 and the flow path block 17 are put in the direction perpendicular or the vertical direction in the figure relative to the conveyance direction of the operation gas flowing from the input block 12 side to the output block 16 side. Thereby, the inlet open/close valve 4 mounted on one side surface of the flow path block 14 and the purge valve 9 mounted on one side surface of the flow path block 17 are arranged sideways in the clearance between the mass flow controller 5 installed on the operation gas supply pipeline and the installation surface in which the gas supply unit 11A is mounted. Therefore, among the fluid control devices 2 to 6 and 9 installed on the gas supply unit 11A, the fluid control devices except the inlet open/close valve 4 and the purge valve 9 are arranged on the operation gas supply pipeline. Moreover, the flow path blocks 14 and 17 are stacked one on top of the other, forming no unnecessary clearance S in the overall length direction of the unit 11A. Therefore, the unnecessary clearance S among the flow path blocks can be reduced compared to a case that one fluid control device is fixed to two flow path blocks. Here, the inlet open/close valve 4 and the purge valve 9 are directly connected to the flow path blocks 14 and 17 respectively. Therefore, in the gas supply unit 11A, the inlet open/close valve 4 and the purge valve 9 do not have to be connected to two flow path blocks as in the prior art (see FIG. 16), so that the number of the blocks and sealing portions can be reduced.

Figure 4:
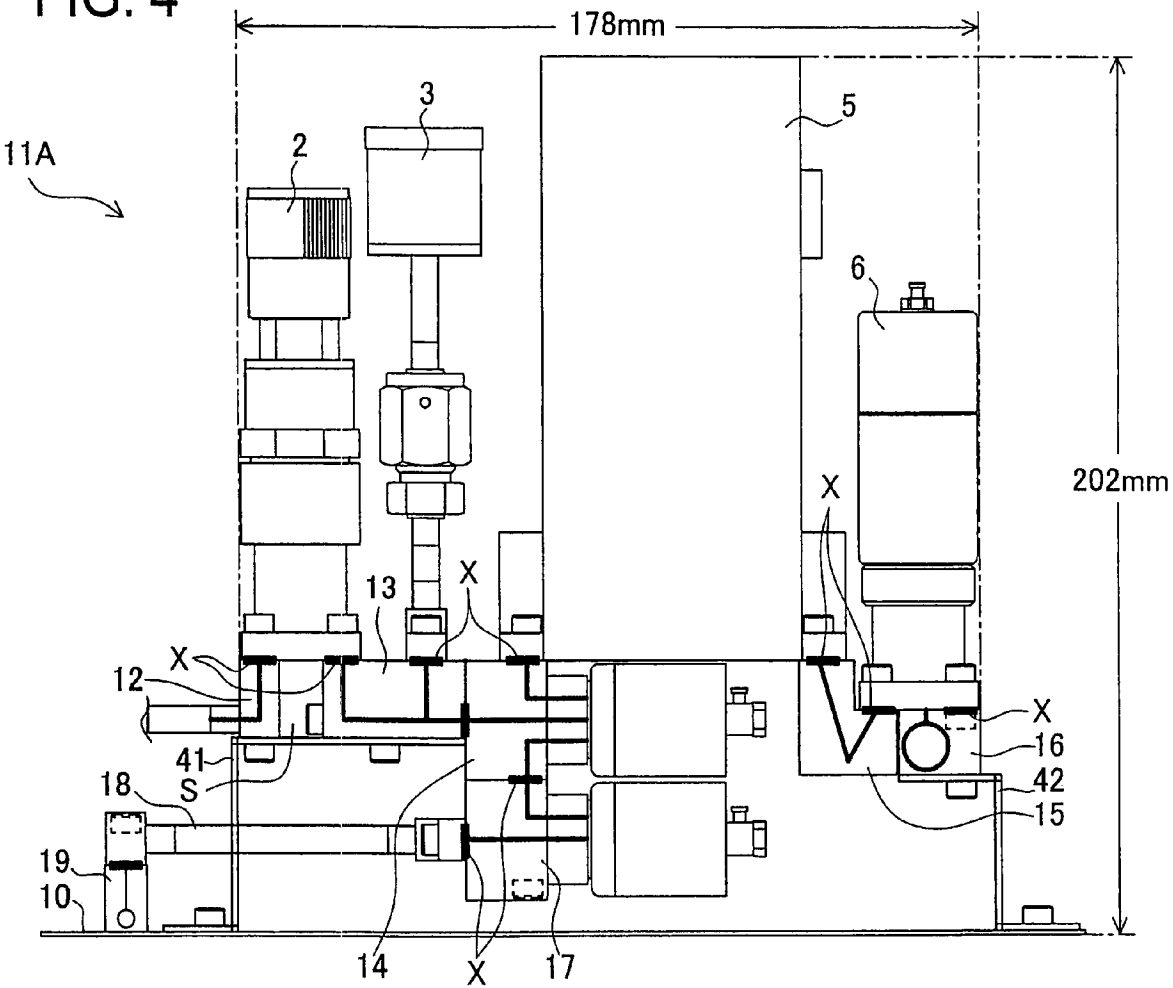
FIG. 4 is a view showing dimensions and sealing portions of the gas supply unit in the first embodiment.
Figure 5:
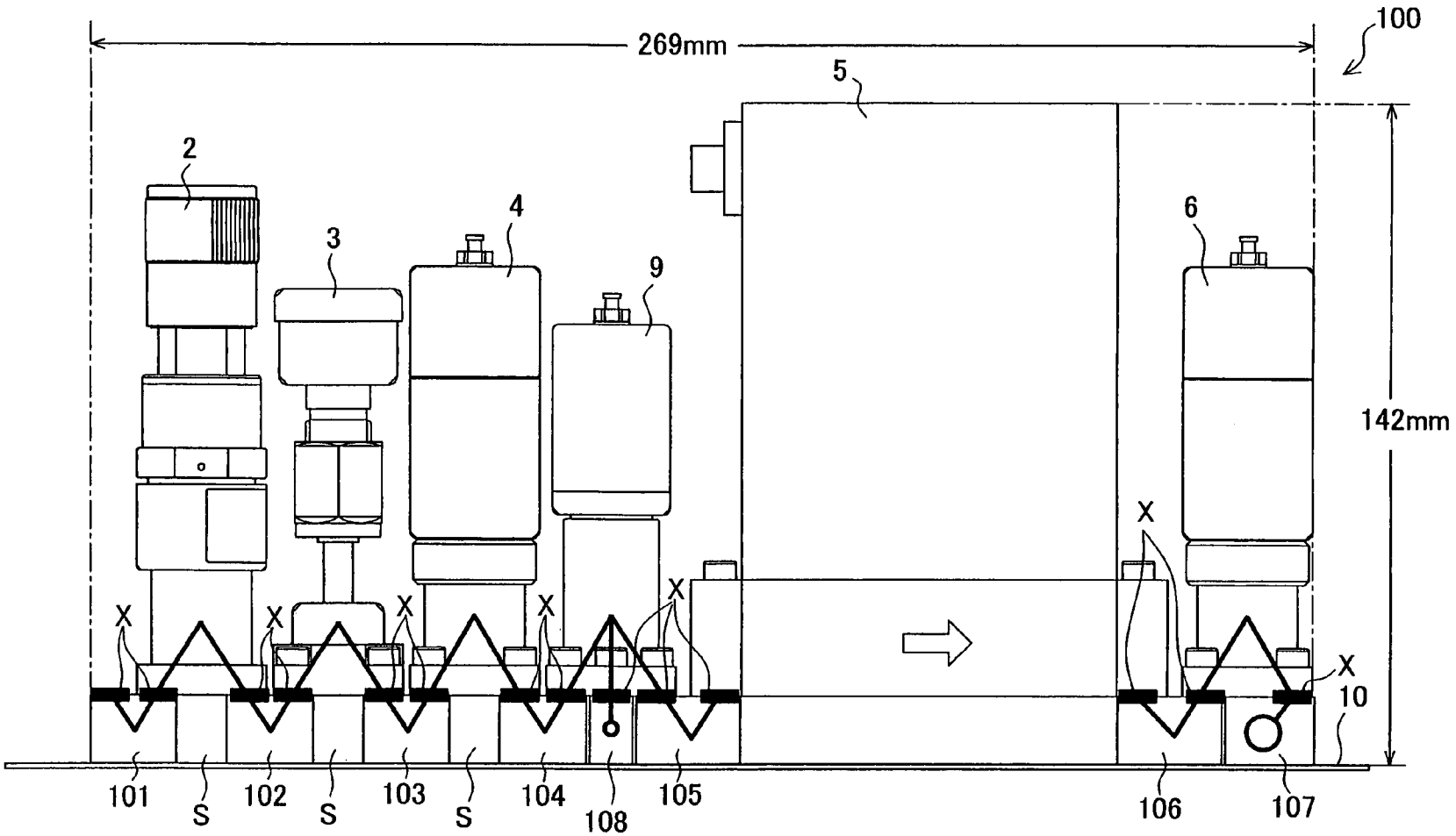
FIG. 5 is a view showing dimensions and sealing portions of a conventional gas supply unit shown in FIG. 16.

The above mentioned advantages are more specifically explained by comparing the gas supply units 11A and 100 both embodying the same circuit. FIG. 4 is a view showing dimensions and sealing positions of the gas supply unit 11A. FIG. 5 is a view showing dimensions and sealing positions of the conventional gas supply unit 100 in FIG. 16. As mentioned above, the gas supply unit 11A and the conventional gas supply unit 100 embody the same circuit shown in FIG. 15.

The gas supply unit 11A has a clearance S only between the input block 12 and the flow path block 13 in the overall length direction. On the other hand, the conventional gas supply unit 100 has three clearances S between the input block 101 and the flow path block 102, between the flow path block 102 and the flow path block 103, and between the flow path block 103 and the flow path block 104. Therefore, the gas supply unit 11A has less clearance amount in the overall length direction compared to the conventional gas supply unit 100. Further, unlike the conventional gas supply unit 100, in the gas supply unit 11A, the inlet open/close valve 4 and the purge valve 9 are not installed along a gas supply line, so that the installation space for the inlet open/close valve 4 and the purge valve 9 can be reduced. As a result, the overall length of the gas supply unit 11A is 178 mm while the overall length of the conventional gas supply unit 100 is 269 mm. In short, the overall length of the gas supply unit 11A can be reduced to about two thirds of that of the conventional gas supply unit 100.

The overall height of the gas supply unit 11A is 202 mm by putting the flow path blocks 14 and 17 one on the other, requiring more space in the height direction compared to the conventional gas supply unit 100 whose overall height is 142 mm. However, in the semiconductor manufacturing device or the like, there is less demand for reducing the space in the height direction even though there are higher demands for reducing the space in the overall length direction or in the width direction. Therefore, the overall height is hardly problematic even if the overall height of the gas supply unit 11A is high.

Furthermore, in the gas supply unit 11A, the inlet open/close valve 4 and the purge valve 9 are directly connected to the flow path blocks 14 and 17, thereby seven blocks in total are required as shown in FIG. 4. On the other hand, in the conventional gas supply unit 100, the inlet open/close valve 4 and the purge valve 9 are fixed to the flow path blocks 103, 104, and 105, and therefore total eight blocks are required. Specifically, the gas supply unit 11A can eliminate one block compared to the conventional gas supply unit 100. Moreover, as shown in FIG. 4, the gas supply unit 11A includes eleven sealing portions X while the conventional gas supply unit 100 includes fourteen sealing portions X as shown in FIG. 5. Thus, the gas supply unit 11A can eliminate three sealing portions X in association with the reduction in the number of blocks compared to the conventional gas supply unit 100.

Consequently, according to the gas supply unit 11A of the present embodiment, unnecessary clearances S among the flow path blocks can be reduced as well as the number of the flow control devices to be installed on the operation gas conveyance pipeline is reduced. Accordingly, the overall length of the unit 11A can be shortened and the unit 11A can be downsized. Further, in the gas supply unit 11A of the present embodiment, the number of the blocks and the sealing portions X are reduced, leading to cost reduction on material cost and processing cost.

When the flow path block 14 and the flow path block 17 are stacked one on the other, the third port 24 opening in the bottom surface of the flow path block 14 and the second port 33 opening in the top surface of the flow path block 17 communicate with each other. In the flow path block 14, the second port 23 opening in the top surface and the third port 24 opening in the bottom surface are communicated via the inlet open/close valve 4. At that time, in the flow path block 17, the second port 33 opening in the top surface and the first port 32 opening in the left side surface opposite the right side surface on which the purge valve 9 is mounted are communicated via the purge valve 9. Therefore, the purge gas supplied to the first port 32 of the flow path block 17 is outputted through the second port 23 opening in the top surface of the flow path block 14 via the purge valve 9 and the inlet open/close valve 4, and then the purge gas can be supplied to the mass flow controller 5 which is installed on the operation gas conveyance pipeline.

Consequently, in the gas supply unit 11A of the present embodiment, only by placing the flow path blocks 14 and 17 one on the other, a flow path capable of controlling the fluid by use of the inlet open/close valve 4 and the purge valve 9 can be easily formed in the vertical direction.

Especially, in addition to the second and third ports 23 and 24 in the top and bottom surfaces, the flow path block 14 is formed with the first port 22 opening in the left side surface opposite the right side surface on which the inlet open/close valve 4 is mounted, and these ports 22, 23, and 24 are mutually communicated via the inlet open/close valve 4. Therefore, the flow path block 13 can be coupled to the flow path block 14 with being in direct contact with the left side surface of the flow path block 14, so that the unit 11A can be downsized to omit unnecessary clearance between the flow path blocks 13 and 14.

The above-mentioned gas supply unit 11A is integrated in such a way that the unit 11A is horizontally held by a pair of the brackets 41 and 42 which are fixed to both ends of the unit 11A, and the brackets 41 and 42 are secured to the installation plate 10 by bolts. Thus systemized gas supply system employs the compact and inexpensive gas supply unit 11A, leading to downsizing and cost reduction of the system itself.

Second Embodiment

A gas supply unit in the second embodiment is, now explained referring to the accompanying drawings.

Figure 6:
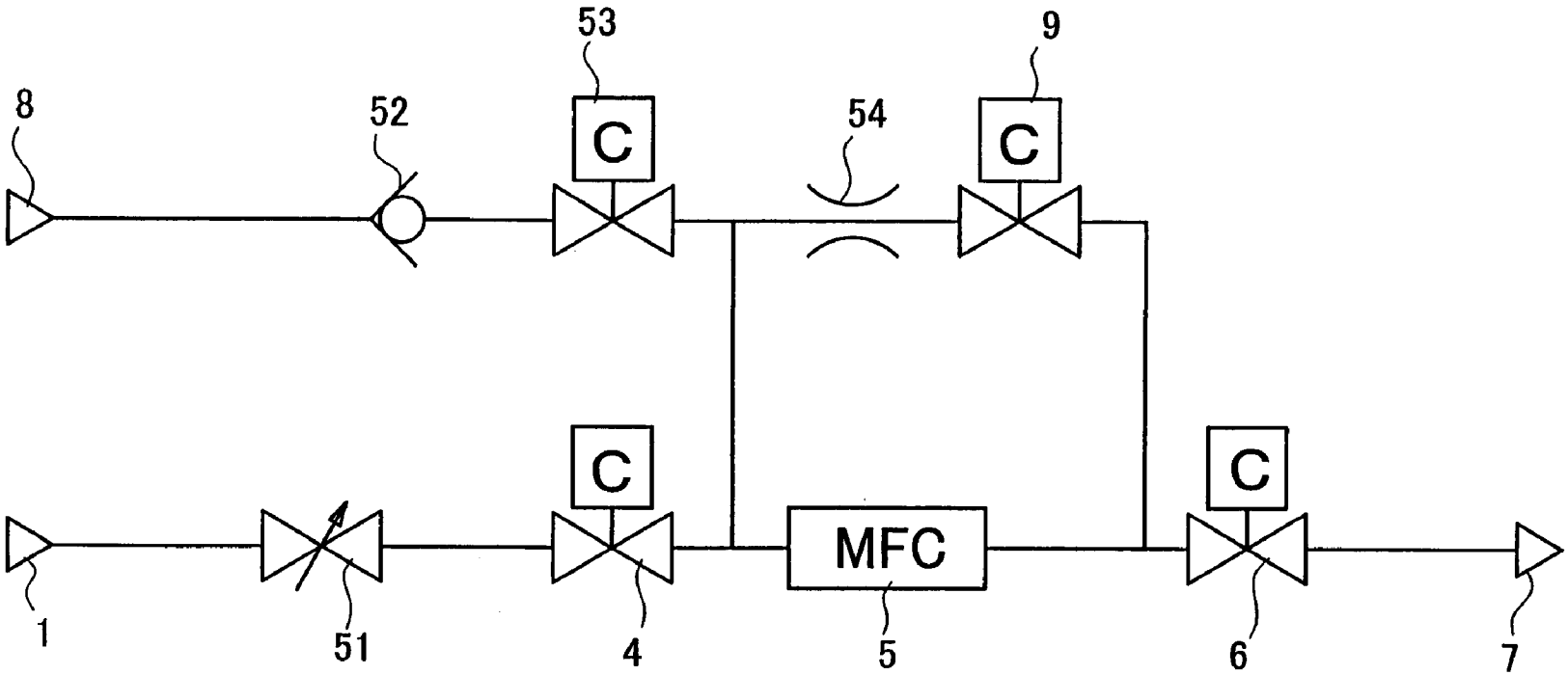
FIG. 6 is a circuit diagram of a gas supply unit in a second embodiment of the present invention.

The gas supply unit in the present embodiment is provided with a different circuit from that of the first embodiment. FIG. 6 is a circuit diagram of the gas supply unit. As for the same configuration with the first embodiment, the same reference codes are given in the drawings, and explanation thereof is accordingly omitted.

The gas supply unit of the present embodiment differs from that of the first embodiment in that a bypass line is formed branching off from a purge line and connected to a downstream side of the mass flow controller 5. In the bypass line, a nozzle 54 for accelerating flow speed and a second purge valve 9 are installed. Further, upstream of the inlet open/close valve 4, a flow rate adjustment valve 51 is provided to supply operation gas inputted from the operation gas supply source 1 to the inlet open/close valve 4 with a minute flow rate. Upstream of a first Surge valve (corresponding to "a first fluid control device" in Claims) 53, a check valve 52 is provided to prevent the operation gas from flowing backward.

Figure 7:
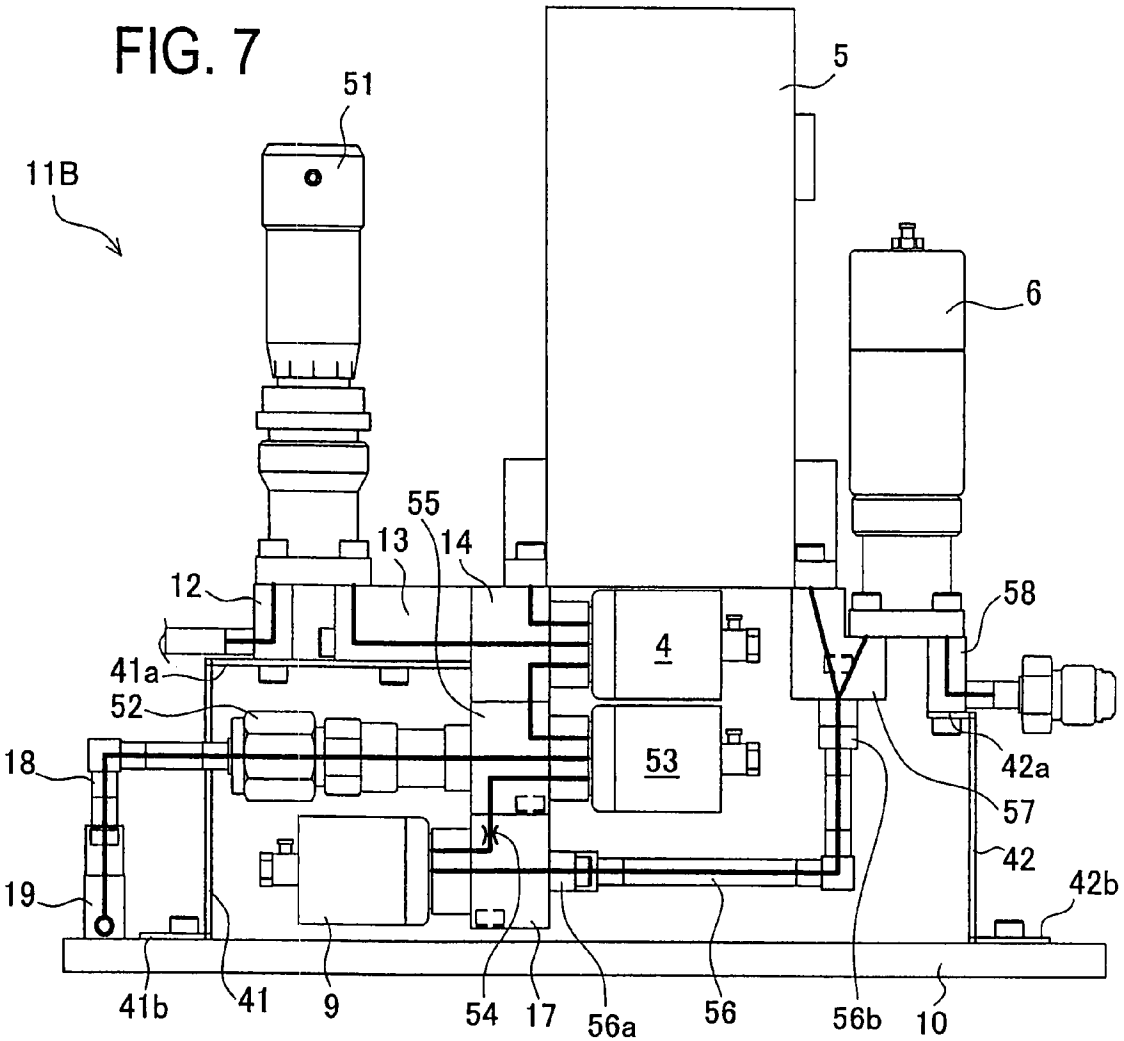
FIG. 7 is a side view of the gas supply unit in the second embodiment.

FIG. 7 is a side view of a gas supply unit 11B.

The gas supply unit 11B of the present embodiment embodies the circuit shown in FIG. 6. In the gas supply unit 11B, the flow path blocks 14, 55, and 17 are stacked one on top of another between the mass flow controller 5 and an installation surface. Accordingly, a clearance created between the mass flow controller 5 and the installation surface is utilized to install a bypass pipe 56. The gas supply unit 11B of the present embodiment includes the same configuration with the gas supply unit 11A of the first embodiment. Therefore, in the present embodiment, the following explanation is made with a focus on a different configuration from the first embodiment. Accordingly, the same reference codes are given to the same components or parts with those of the first embodiment and the explanation thereof is omitted as appropriate.

In the gas supply unit 11B, the flow path block 55 is arranged between the flow path blocks 14 and 17, i.e., three flow path blocks are stacked one on top of another. The flow path blocks 14, 17, and 55, having the same outer shapes, are connected vertically like a bar.

The flow path block 55 has mostly the same flow path structure with the flow path block 14. Specifically, the first purge valve 53 is screwed to the right side surface of the flow path block 55 in the figure, and a first port is provided on the left side surface opposite the right side surface engaged with the first purge valve 53. Further, a second port is provided in a bottom surface, and a third port is provided in a top surface of the flow path block 55. The check valve 52 is directly connected with the flow path block 55 on the left side surface thereof in the figure to communicate with the first port. The check valve 52 is communicated with the purge block 19 via the purge pipe 18 to allow the purge gas to flow only into the first purge valve 53. In addition, the second port of the flow path block 55 is opening at a position corresponding to the second port 33 of the flow path block 17. Therefore, the second and third ports are not formed in alignment with each other, which is different from those of the flow path block 14.

The bypass pipe 56 is fixed with the flow path block 17 and a flow path block 57. The bypass pipe 56 is installed downstream of the mass flow controller 5 and thus the flow path block 17 is arranged in a different orientation 180 degrees opposite to the orientation in the first embodiment. Consequently, the second purge valve 9 is placed sideways between the installation surface and the flow rate adjustment valve 51 on the operation gas conveyance pipeline, and the valve 9 and the check valve 52 are arranged one above the other. In the second port 33 of the flow path block 17, the nozzle 54 is loaded. Furthermore, the first port 32 is communicated with the bypass pipe 56. The bypass pipe 56 is integrated with the flow path block 17 by fastening bolts running through a fixing block 56*a* with the bolt holes 38 of the flow path block 17.

The other end of the bypass pipe 56 is fixed with the flow path block 57 provided downstream of the mass flow controller 5. The bypass pipe 56 is integrated with the flow path block 57 in such a way that a fixing block 56*b* is placed in contact with a bottom surface of the flow path block 57 and fastened by a bolt running through the flow path block 57 from above. The mass flow controller 5 is placed on the top surfaces of the flow path blocks 14 and 57 and fixed to them from above by bolts. The outlet open/close valve 6 is fixed to the top surfaces of the flow path block 57 and an output block 58 by bolts. In this case, in the flow path block 57, an input port communicating with the mass flow controller 5 and an output port communicating with the outlet open/close valve 6 are both communicated with a purge gas input port opening at a bottom surface of the flow path block 57. Thereby, the flow path block 57 is configured to merge the purge gas flowing from the mass flow controller 5 and the purge gas flowing from the bypass pipe 56 and supplies the thus merged purge gas to the outlet open/close valve 6.

Figure 8:
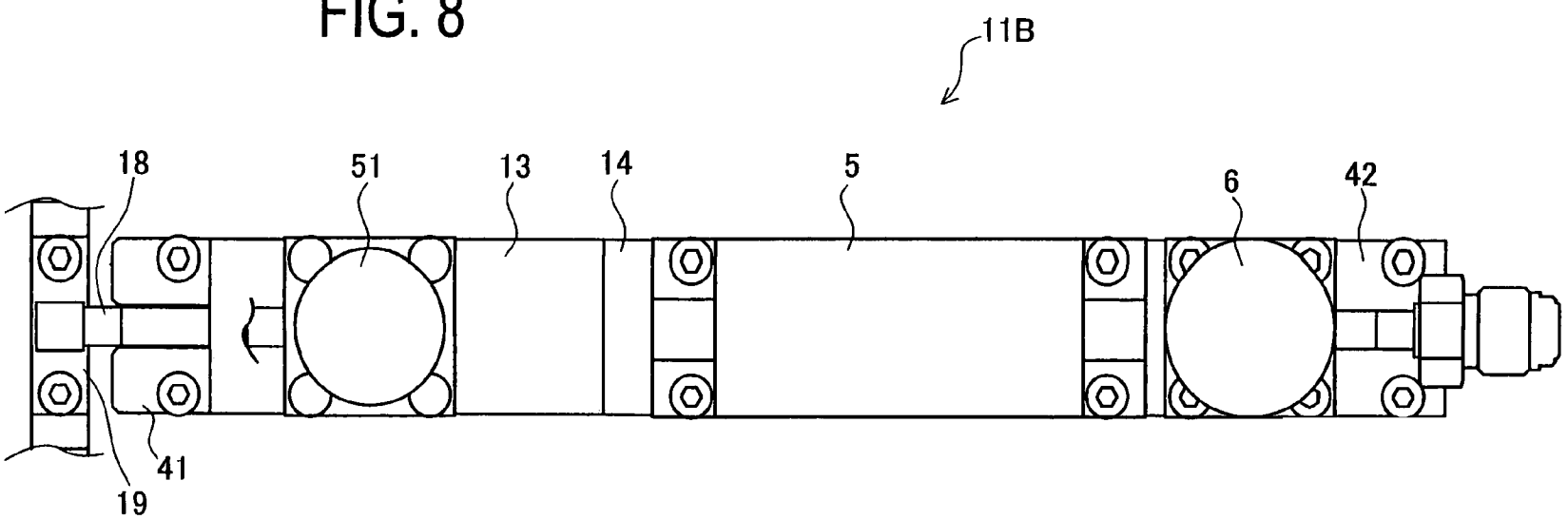
FIG. 8 is a plan view of the gas supply unit in the second embodiment.

FIG. 8 is a plan view of the gas supply unit 11B.

As clear from the figure, in the gas supply unit 11B, the bypass pipe 56 is arranged between the mass flow controller 5 and the installation surface, so the bypass pipe 56 is installed without protruding in a width direction of an operation gas supply line.

Figure 9:
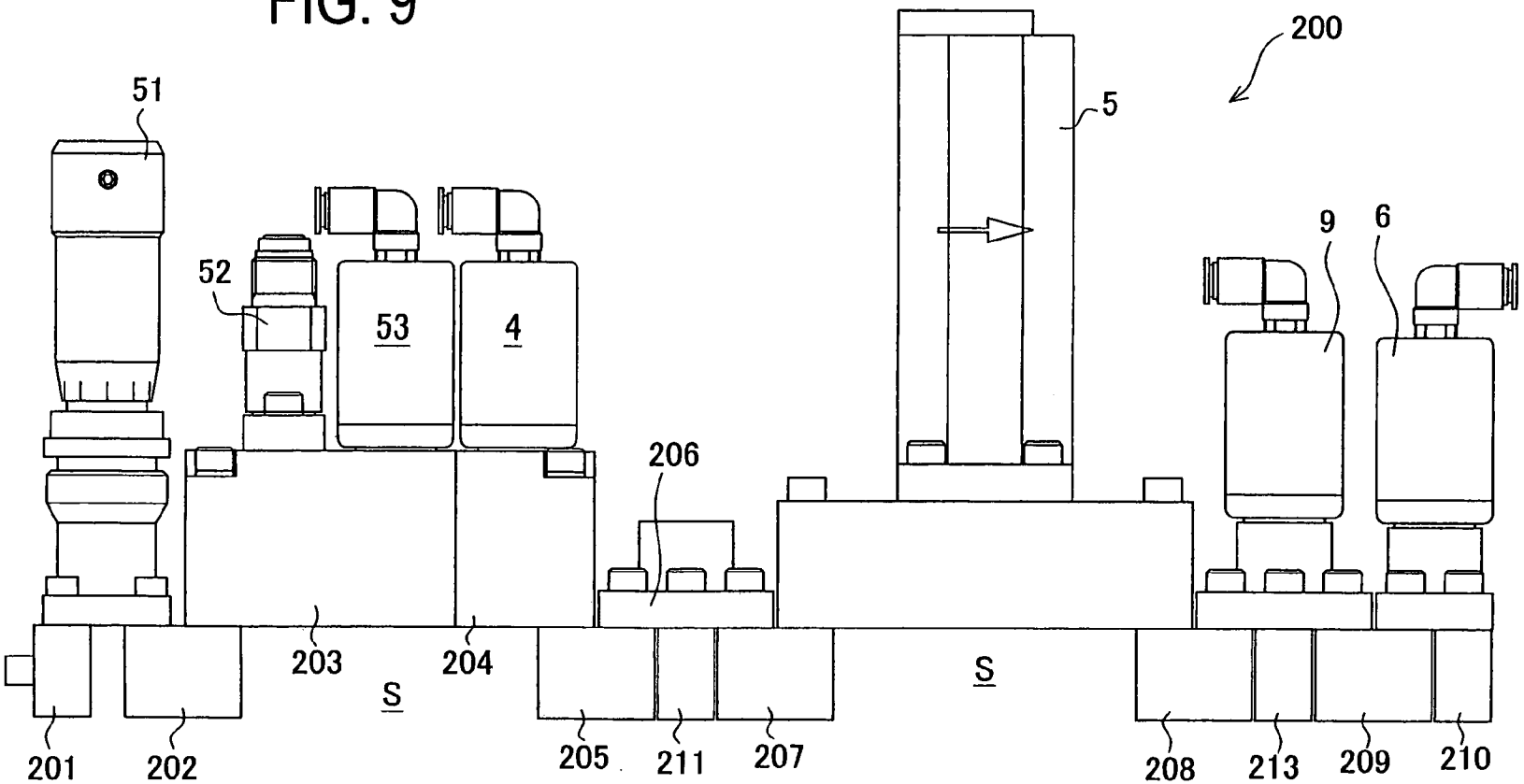
FIG. 9 is a side view of a conventional gas supply unit embodying the circuit shown in FIG. 6 according to the second embodiment.

Next, a conventional gas supply unit 200 embodying the circuit shown in FIG. 6 is now examined. FIG. 9 is a side view of the conventional gas supply unit 200 which embodies the circuit in FIG. 6.

The gas supply unit 200 is configured such that one device is mounted on two flow path blocks. The gas supply unit 200 includes, for an operation gas supply line, an input block 201, the flow rate adjustment valve 51, a flow path block 202, a purge block 203, a switch block 204, a flow path block 205, a branch block 206, a flow path block 207, the mass flow controller 5, a flow path block 208, the second purge valve 9, a flow path block 209, the outlet open/close valve 6, and an output block 210. The gas supply unit 200 further includes, for a purge gas line, the check valve 52, the purge block 203, the first purge valve 53, the switch block 204, the inlet open/close valve 4, the flow path block 205, the branch block 206, and the flow path block 207. Consequently, the conventional gas supply unit 200 in which the inlet open/close valve 4, the check valve 52, the first purge valve 53, and the second purge valve 9 are arranged on the operation gas conveyance pipeline is longer in overall length than the gas supply unit 11B of the present embodiment. Moreover, in the conventional gas supply unit 200, unnecessary clearances S are created below the purge block 203 and the switch block 204 and below the mass flow controller 5.

Figure 10:
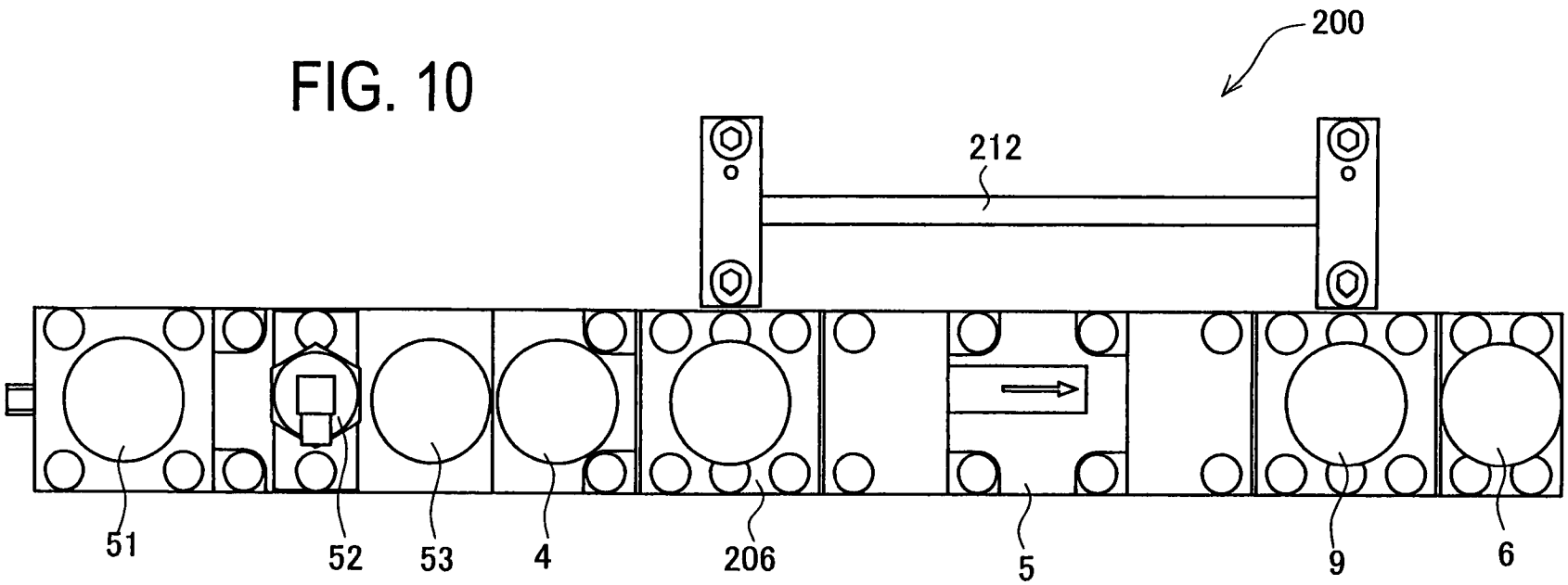
FIG. 10 is a plan view of the conventional gas supply unit embodying the circuit shown in FIG. 6 according to the second embodiment.

FIG. 10 is a plan view of the conventional gas supply unit 200 which embodies the circuit shown in FIG. 6.

In the gas supply unit 200, a bypass line is made up of the branch block 206, an upstream bypass block 211, a bypass pipe 212, and a downstream bypass block 213. In such a configuration, the bypass pipe 212 projects in the width direction of the gas supply unit 200. In short, the gas supply unit 200 includes two lines, i.e., the operation gas supply line and the bypass line arranged in parallel in the width direction. Consequently, the conventional gas supply unit 200 requires wider installation space in the width direction than the gas supply unit 11B of the present embodiment.

As a result, in the gas supply unit 11B of the present embodiment, one end of the bypass pipe 56 is connected to the flow path block 17, and the other end thereof is connected to the flow path block 57 which is installed on the operation gas supply pipeline. Accordingly, the bypass pipe 56 is arranged between the mass flow controller 5 installed on the operation gas supply pipeline and the installation surface, so that the bypass pipe 56 can be provided in an occupation space for one line.

Furthermore, in the gas supply unit 11B of the present embodiment, the flow path block 55 is formed with the first port on a side surface opposite the side surface connected with the first purge valve 53 and is directly connected with the check valve 52, so that the number of the fluid control devices to be installed on the operation gas conveyance pipeline can be reduced.

Moreover, when the flow path blocks 14, 55, and 17 are stacked one on top of another, clearances are created not only beneath the mass flow controller 5 but also beneath the flow rate adjustment valve 51. In the gas supply unit 11B, such spaces created at both sides of the flow path blocks 55 and 17 are utilized to dispose the fluid control devices 52, 53, and 9 and the bypass pipe 56 in opposite directions from the flow path blocks 55 and 17. Thus, the clearance created under the unit is effectively utilized, so that the device can be efficiently downsized.

Third Embodiment

Figure 11:
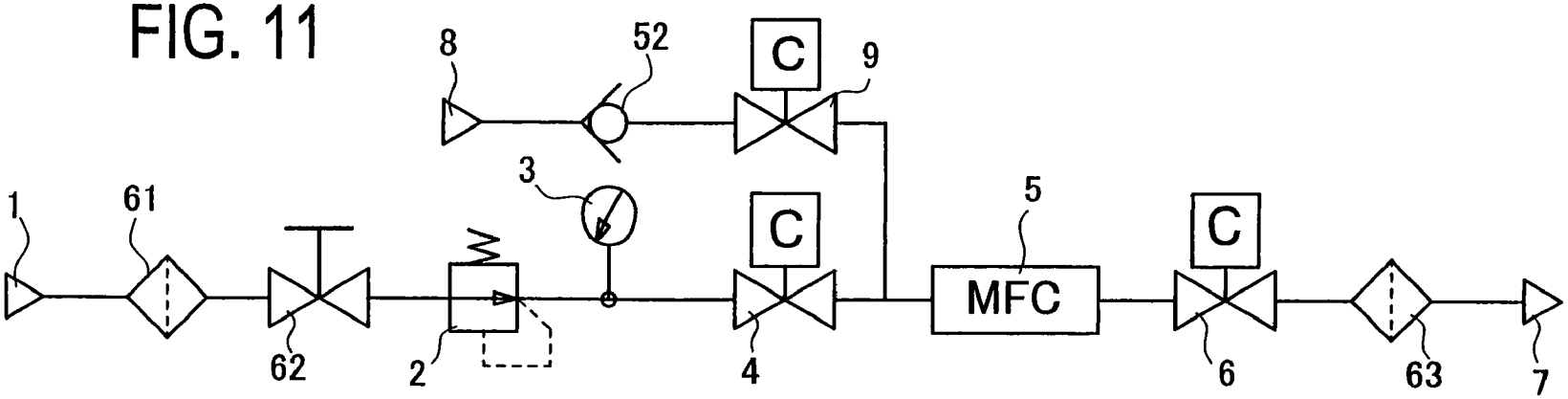
FIG. 11 is a circuit diagram of a gas supply unit in a third embodiment of the present invention.

A gas supply unit in the third embodiment of the present invention is now explained referring to the accompanying drawings. FIG. 11 is a circuit diagram of the gas supply unit.

The present embodiment employs a different circuit from the first embodiment. Specifically, filters 61 and 63 are provided on an input side and an output side, a manual valve 62 is arranged between the filter 61 and a regulator 2, and the check valve 52 is placed upstream of the purge valve 9, which are different from those of the first embodiment.

Figure 12:
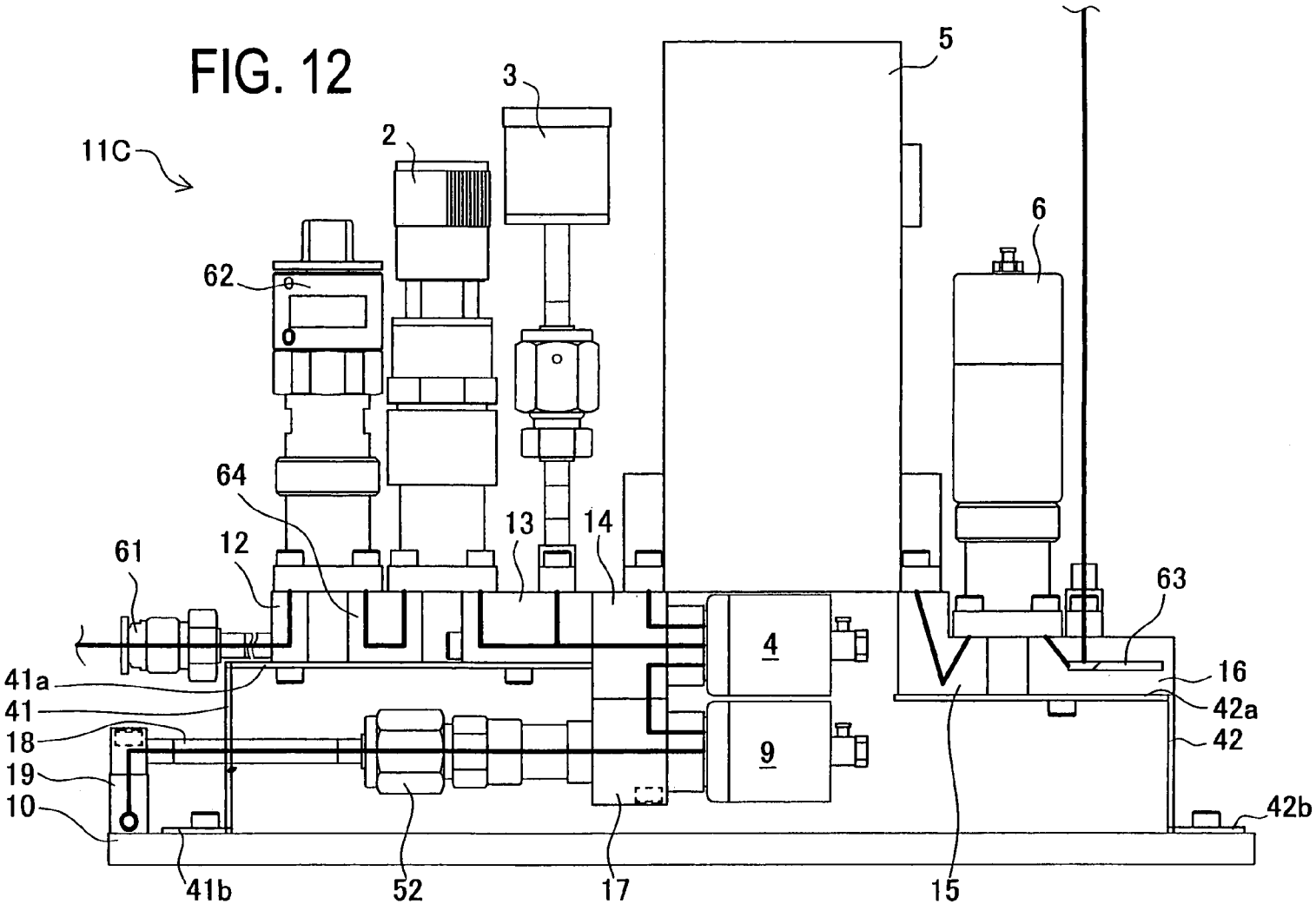
FIG. 12 is a side view of the gas supply unit embodying the circuit shown in FIG. 11 according to the third embodiment.

FIG. 12 is a side view of a gas supply unit 11C which embodies the circuit shown in FIG. 11.

In the gas supply unit 11C, the manual valve 62 is fixed on top surfaces of the input block 12 and a flow path block 64 by bolts from above. On an input port of the input block 12, the filter 61 is mounted to remove impurities from operation gas so that such the purified operation gas is inputted to the manual valve 62. The regulator 2 is fixed on the top surfaces of the flow path block 64 and the flow path block 13 by bolts from above. Further, an input port of the regulator 2 communicates with an output port of the manual valve 62, and an output port thereof communicates with the inlet open/close valve 4 via the flow path blocks 13 and 14. Furthermore, the filter 63 is embedded in the output block 16, so that gas from which impurities are removed by the filter 63 is outputted to the vacuum chamber 7. In addition, the check valve 52 is fixed on the left side surface of the flow path block 17 in the figure by a bolt to communicate with the first port 32, thereby the flow path block 17 communicates with the purge block 19 via the check valve 52 and the purge pipe 18.

Accordingly, in the gas supply unit 11C of the present embodiment, devices needing specific operation, such as the manual valve 62 and the regulator 2 which are to be manipulated by an operator, the filters 61 and 63 which require regular maintenance, and the pressure sensor 3 which needs to be visually checked by an operator, are mounted on the blocks 12, 64, and 13 and installed on the operation gas conveyance pipeline. On the other hand, the check valve 52 which is less frequently operated and others are arranged between the devices 62, 2, 3, and 5 installed on the operation gas conveyance pipeline and the installation surface. Therefore, the gas supply unit 11C can be downsized without deteriorating the operation performance (workability) and the maintenance.

Fourth Embodiment

Figure 13:
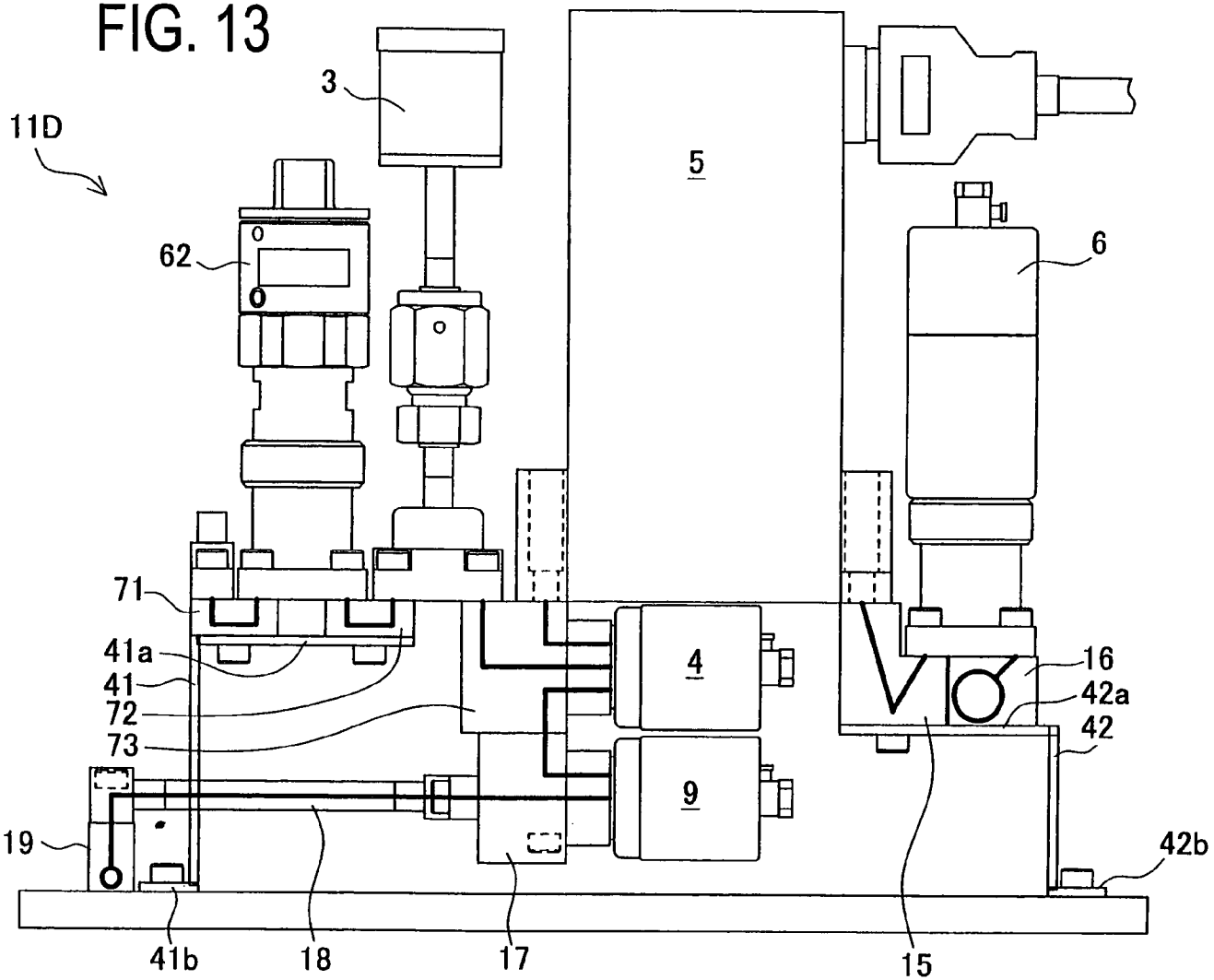
FIG. 13 is a side view of a gas supply unit in a fourth embodiment of the present invention.

The fourth embodiment of the present invention is now explained referring to the accompanying drawings. FIG. 13 is a side view of a gas supply unit 11D.

The gas supply unit 11D of the present embodiment differs from the first embodiment in that a flow path block (corresponding to "a first flow path block" in Claims) 73 is employed instead of the flow path block 14, the manual valve 62 is used instead of the regulator 2, and the pressure sensor 3 is directly connected to the flow path block 73. Therefore, hereinafter, the explanation is made with a focus on the differences from the first embodiment by giving the same reference codes to the same components in the figure and the explanation thereof is omitted.

The manual valve 62 is fixed on top surfaces of an input block 71 and a flow path block 72 by bolts from above, and the pressure sensor 3 is fixed on the top surfaces of the flow path block 72 and the flow path block 73 by bolts from above. The input block 71 and the flow path block 72 are of the same shapes, and the input block 71 is made to introduce operation gas from above. The input block 71 and the flow path block 72 are designed to be lower in height than the input block 12 and the flow path block 13 in the first embodiment. This is because the output port of the pressure sensor 3 is directly connected to a port opening in the top surface of the flow path block 73, so that the flow path block 72 does not need to have a port in the right side surface thereof. Thus, by using the blocks 71 and 72 with lower heights, weight saving and cost reduction can be achieved. However, in the flow path block 73, since two fluid control devices (herein, the pressure sensor 3 and the mass flow controller 5) are fixed on the top surface thereof, the width dimension in the overall length direction is made larger than that of the flow path block 17.

Figure 14A:
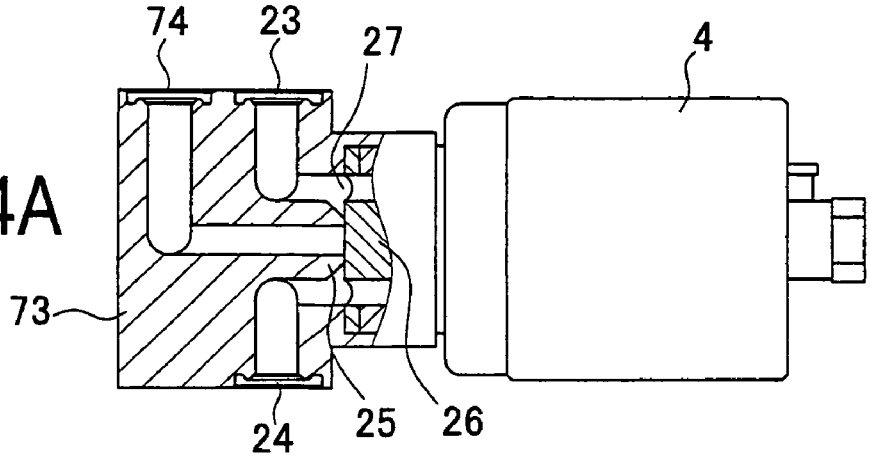
FIG. 14A is a sectional view of a main part of a flow path block on which a fluid control device is mounted, showing a structure of the flow path block employed in the gas supply unit in the fourth embodiment.
Figure 14B:
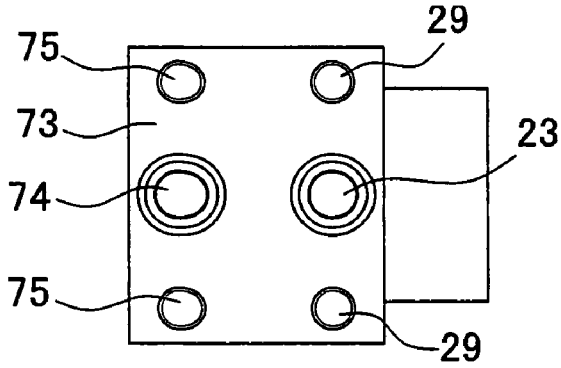
FIG. 14B is a top view of the flow path block in FIG. 14A.
Figure 14C:
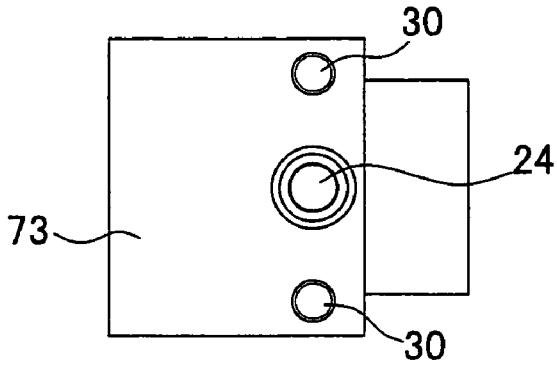
FIG. 14C is a bottom view of the flow path block in FIG. 14A.

FIGS. 14 are views showing a structure of the flow path block 73. FIG. 14A is a sectional view showing a main part of the flow path block 73 in which the fluid control device is mounted, FIG. 14B is a top view, and FIG. 14C is a bottom view of the flow path block 73.

The flow path block 73 has basically the same flow path structure with the flow path block 14 shown in FIGS. 2, but it is different from the flow path block 14 in the first embodiment in that a first port 74 and the second port 23 are provided on the top surface. As shown in FIG. 14B, on the top surface of the flow path block 73, a pair of bolt holes 75 are formed at both sides of the first port 74 so that the flow path block 73 is evenly sealed when a gasket (not shown) is pressed between the top surface of the flow path block 73 and the bottom surface of the pressure sensor 3.

In the gas supply unit 11D, the operation gas inputted to the input block 71 is further inputted to the first port 74 of the flow path block 73 via the flow path block 72 and the pressure sensor 3. When the inlet open/close valve 4 is opened and the purge valve 9 is closed, the operation gas is sequentially outputted to the valve seat 25 and the valve chamber 27 of the flow path block 73, the second output port 23, and then supplied to the vacuum chamber 7 through the mass flow controller 5 and the outlet open/close valve 6.

On the other hand, when the inlet open/close valve 4 is closed and the purge valve 9 is opened, the operation gas does not flow into the valve chamber 27 from the valve seat 25 of the flow path block 73, but the purge gas is supplied from the purge valve 9 to the mass flow controller 5 through the third port 24, the vacuum chamber 27, and the second port 23 of the flow path block 73. Accordingly, the purge gas is discharged to the vacuum chamber 7 through the outlet open/close valve 6.

Consequently, the gas supply unit 11D of the present embodiment can increase the degree of freedom of available circuit design only by changing the positions of the ports of the flow path blocks 14, 17, and 73 which are stacked corresponding to types of the fluid control devices to be mounted in the unit 11D.

The present invention may be embodied in other specific forms without departing from the essential characteristics thereof.

(1) For example, in the above mentioned embodiments, the explanation is made for the gas supply units 11A to 11D which are to be mounted in a semiconductor manufacturing device. Alternatively, the gas supply units 11A to 11D may be employed in every industrial field which employs a CVD device, an etching device, and others.

(2) For example, in the above mentioned embodiments, each of the gas supply units 11A to 11D is fixed to the installation plate 10, but a rail may be employed as an installation member instead. In this case, as long as the brackets 41 and 42 are shaped to be engaged with the rail and each of the gas supply units 11A to 11D is moved to be fixed at a certain position along the rail, the gas supply units 11A to 11D can be more easily systemized.

(3) For example, in the above mentioned embodiments, each flow path block and each fluid control device are made of metal having thermal resistance and rigidity. Alternatively, in a case of controlling high corrosive gas or the like, resin like PTFE and PP may be employed as a material for flow path blocks and fluid control devices.

The invention claimed is:

1. A gas supply unit comprising:

an input block connected to operation gas supply source to input operation gas;

an output block outputting the operation gas to an operation gas supply destination;

a first fluid control device and a second fluid control device controlling the operation gas;

a third fluid control device controlling the operation gas, being arranged in a conveyance direction conveying the operation gas from the input block to the output block;

a first flow path block having a side surface on which the first fluid control device is attached; and a second flow path block having a side surface on which the second fluid control device is attached, wherein the first flow path block and the second flow path block are stacked one on top of the other in a direction perpendicular to the conveyance direction conveying the operation gas from the input block to the output block, and the first fluid control device and the second fluid control device are arranged between the third fluid control devices and an installation surface on which the gas supply unit is to be installed, the first flow path block is formed with at least one port each on a top surface and a bottom surface, the ports communicating with each other via the first fluid control device, and the second flow path block is formed with at least one port each on a top surface and a side surface opposite a side surface to which the second fluid control device is attached, the ports communicating with each other via the second fluid control device.

2. The gas supply unit according to claim 1, wherein the first flow path block is formed with at least one port opening in a side surface opposite a side surface to which the first fluid control device is attached, the port communicating with the ports opening in the top surface and the bottom surface of the first flow path block via the first fluid control device.

3. The gas supply unit according to claim 2, wherein a bypass pipe is arranged between the third fluid control device and the installation surface, wherein one end of the bypass pipe is connected to the first flow path block or the second flow path block, and the other end of the bypass pipe is connected to a flow path block mounted between the input block and the output block.

4. A gas supply system comprising:

a plurality of gas supply units set forth in claim 3, a plurality of pairs of brackets each pair of which is mounted on both ends of each gas supply unit for horizontally holding it; and an installation member to which the pair of brackets are fixed, wherein the pairs of brackets are fixed to the installation member and the gas supply units are integrated together.

5. A gas supply system comprising:

a plurality of gas supply units set forth in claim 2, a plurality of pairs of brackets each pair of which is mounted on both ends of each gas supply unit for horizontally holding it; and an installation member to which the pair of brackets are fixed, wherein the pairs of brackets are fixed to the installation member and the gas supply units are integrated together.

6. The gas supply unit according to claim 1, wherein a bypass pipe is arranged between the third fluid control device and the installation surface, wherein one end of the bypass pipe is connected to the first flow path block or the second flow path block, and the other end of the bypass pipe is connected to a flow path block mounted between the input block and the output block.

7. A gas supply system comprising:

a plurality of gas supply units set forth in claim 6, a plurality of pairs of brackets each pair of which is mounted on both ends of each gas supply unit for horizontally holding it; and an installation member to which the pair of brackets are fixed, wherein the pairs of brackets are fixed to the installation member and the gas supply units are integrated together.

8. A gas supply system comprising:

a plurality of gas supply units set forth in claim 1, a plurality of pairs of brackets each pair of which is mounted on both ends of each gas supply unit for horizontally holding it; and an installation member to which the pair of brackets are fixed, wherein the pairs of brackets are fixed to the installation member and the gas supply units are integrated together.

* * * * *